US006848388B2

(12) United States Patent
Shields

(10) Patent No.: US 6,848,388 B2
(45) Date of Patent: Feb. 1, 2005

(54) QUICK RELEASE FASTENER FOR FLAGS AND FLAG STAFFS

(76) Inventor: Robert Shields, P.O. Box 183, Miltona, MN (US) 56354

( * ) Notice: Subject to any disclaimer, the term of this patent is extended or adjusted under 35 U.S.C. 154(b) by 0 days.

(21) Appl. No.: 10/206,326

(22) Filed: Jul. 29, 2002

(65) Prior Publication Data

US 2004/0016389 A1 Jan. 29, 2004

(51) Int. Cl.[7] ..... G09F 17/00

(52) U.S. Cl. ..... 116/173; 403/348; 403/329; 411/552; 411/553

(58) Field of Search ..... 116/173, 28 R; 248/222.51, 222.11, 222.12; 403/348, 349, 350, 351, 326, 329; 411/553, 552, 551, 550, 549, 349

(56) References Cited

U.S. PATENT DOCUMENTS 3,611,861 A * 10/1971 Schulze ..... 411/508
D257,245 S * 10/1980 Neal ..... D11/181
4,604,776 A * 8/1986 Takahashi ..... 24/453
5,191,513 A * 3/1993 Sugiura et al. ..... 361/752
5,397,130 A 3/1995 Brown
5,615,635 A 4/1997 Deviney
5,732,927 A 3/1998 Purpura
5,904,116 A 5/1999 Wyner et al.
6,237,970 B1 * 5/2001 Joannou ..... 292/241

* cited by examiner

*Primary Examiner*—Christopher W. Fulton
*Assistant Examiner*—Tania C. Courson
(74) *Attorney, Agent, or Firm*—Siemens Patent Services, LC

(57) ABSTRACT

An apparatus for quickly installing a flag on and removing a flag from a golf hole flag staff is disclosed. A flag staff attachment having laterally displaceable retaining clips is threaded onto the top of a golf hole flag staff, and a retainer cap is installed through the aperture at the top of the sleeve of a golf hole flag. Laterally displaceable retaining clips on the retaining cap engage the flag sleeve's aperture, thereby securing the retaining cap to the flag. An engagement member on the retaining cap displaces the retaining clips of the flag staff attachment, thereby allowing the engagement member to pass therebetween, thereby securing the flag to the staff.

12 Claims, 4 Drawing Sheets

QUICK RELEASE FASTENER FOR FLAGS AND FLAG STAFFS

BACKGROUND OF THE INVENTION

1. Field of the Invention

The present invention relates to sporting equipment, especially as it relates to the game of golf. More particularly, the invention comprises a system for quickly and easily changing the flag attached to a staff used for indicating a golf green hole.

2. Description of the Prior Art

In the game of golf, the hole, or cup, is typically relocated to various spots around the green on a regular basis. This periodic relocation facilitates even wear of the grasses of the green and increases the challenge of the course by moving the target hole. A staff topped with a flag is placed in the hole so that a golfer may determine the location of the hole from the tee or the fairway, up to several hundred yards away. The flags are coded, usually by color, to indicate whether the hole is toward the front, center or rear of the green, thereby aiding the golfer in selecting the club to use for the distance to the hole. Therefor, it is desirable to be able to easily and quickly change the flag whenever the hole is moved.

In the past, a variety of flag mounting systems have been propounded, including:

U.S. Pat. No. 5,904,116, issued to Stewart A. Wyner, et al., on May 18, 1999, presents a REVOLVING PENNANT, in which a pennant is suspended from a pivot assembly which, in turn is pivotally mounted around the top of a handle. The assembly of Wyner, et al., tends to serve as a base for a single flag, while that of the current invention is designed to facilitate quick and easy change of flags.

U.S. Pat. No. 5,732,927, issued to James A. Purpura on Mar. 31, 1998, presents a VEHICLE FLAG MOUNTING ASSEMBLY attachment to the licence plate frame of a vehicle, such as a motorcycle. A flag or pennant is attached to the mast of Purpura's assembly by bolts passing through apertures in an attachment blade and the eyelets of the flag, requiring the use of wrenches or plyers. By contrast, the present invention requires only the uncoupling of a fastener, by a simple twist of the hand, to change flags.

U.S. Pat. No. 5,615,635, issued to Jerry P. Deviney on Apr. 1, 1997, presents a CUP PLACEMENT INDICATOR in which a flag holder having a flag attachment device is semi-permanently attached over the top of the flag staff, typically with a nut engaging a threaded bolt extending from the top of the flag staff. Interchangeable flags are then, individually, attached to the flag attachment device by methods such as velcro, zippers or snaps. By contrast, in the present invention, standard flags may be used, as opposed to flags specially made for the snap cap.

U.S. Pat. No. 5,397,130, issued to David C. Brown on Mar. 14, 1995, presents a PORTABLE FLAG-TARGET FOR FLYING-DISC GAME AND METHOD OF MANUFACTURE THEREOF, a two section flag pole for use in the playing of disc golf. While providing for reduction in length of the pole for carrying and storage, Brown fails to provide the secure, quick release flag changing capabilities of the present invention.

None of the above inventions and patents, taken either singly or in combination, is seen to describe the instant invention as claimed.

SUMMARY OF THE INVENTION

The present invention comprises an apparatus for quickly and easily changing the flag on the staff marking the hole on a golf green.

Accordingly, it is a principal object of the invention to provide a quick release fastener which is easy to use.

It is another object of the invention to provide a quick release fastener which is durable.

It is a further object of the invention to provide a quick release fastener which is economical.

Still another object of the invention is to provide a quick release fastener which may be used with standard, commercially available flags.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
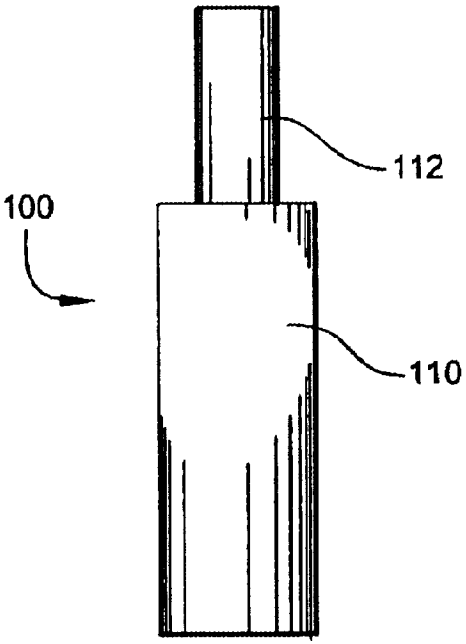
Fig. 1 Prior Art
FIG. 1 is a front view of a typical flag staff as is commonly known in the golfing industry.
Figure 5:
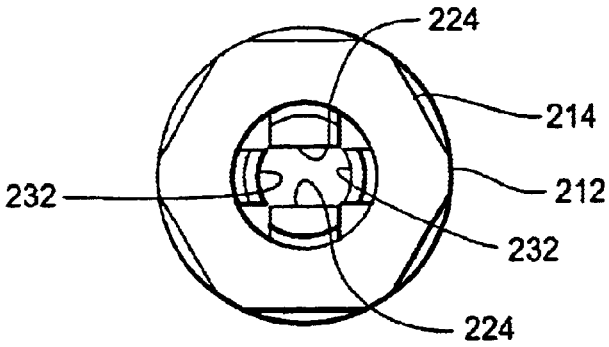
FIG. 5 is a bottom view of the flag staff attachment of FIG. 2.
Figure 4:
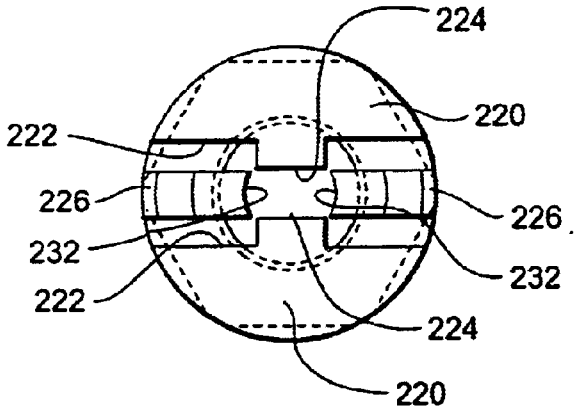
FIG. 4 is a top view of the flag staff attachment of FIG. 2.
Figure 8:
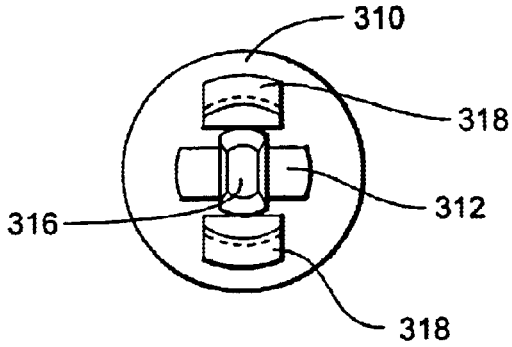
FIG. 8 is a bottom view of the retaining cap of FIG. 6.
Figure 7:
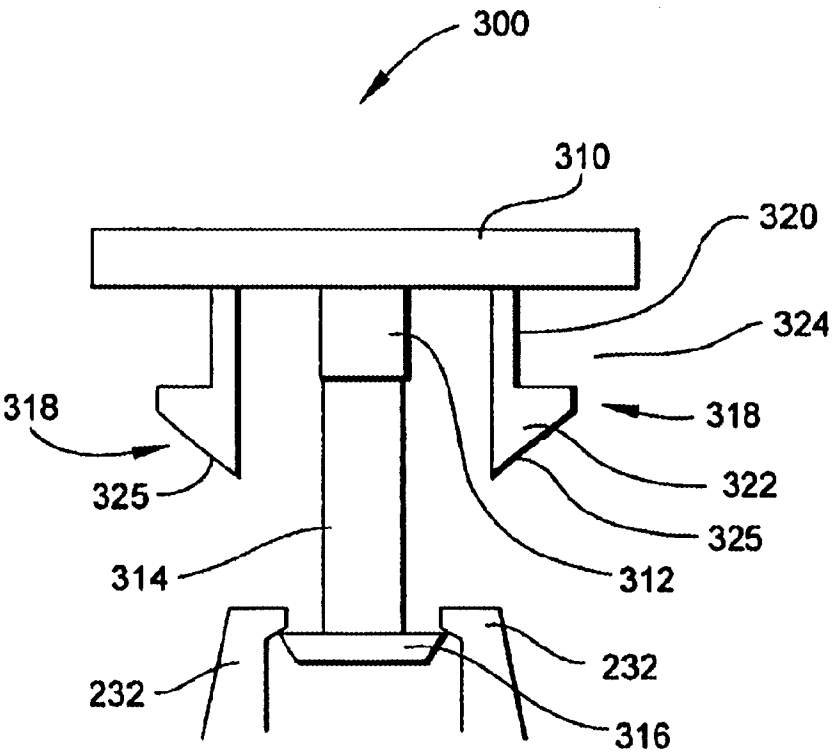
FIG. 7 is a side view of the retaining cap for the flag tube of FIG. 6.
Figure 6:
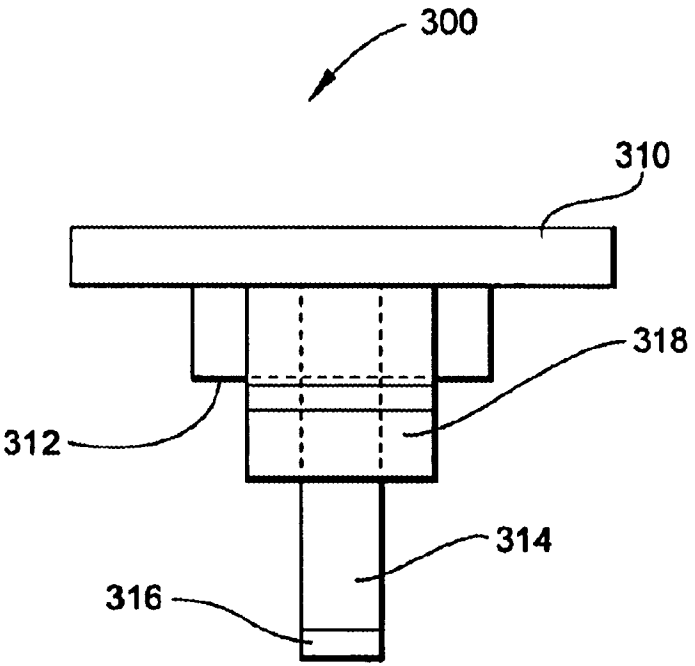
FIG. 6 is a front view of the retaining cap of the present invention.

The quick release fastener of the present invention is composed of two basic elements, a flag staff attachment 200, as depicted in FIGS. 2 thru 5, and a retaining cap 300, as depicted in FIGS. 6 thru 8, which are used in conjunction with a standard flag staff 100, FIG. 1.

Referring first to FIG. 1, while not deemed to be a part of the present invention, a typical flag staff 100 consists of a shaft 110 topped by a threaded rod 112. A sleeve (not shown) formed in a flag (not shown) is typically slipped over shaft 110 such that threaded rod 112 extends through an aperture (not shown) in the top of the sleeve (not shown) and then secured with a nut (not shown). The instant invention is adapted to utilize the basic structure of flag staff 100, as will be described hereinbelow.

Referring now to FIGS. 2 thru 5, flag staff attachment 200 has a body 210 having a substantially cylindrical exterior 212 having a diameter substantially equal to that of a typical flag staff 100, and a substantially hollow interior. At a first, lower end, the round exterior transitions to a hexagonal exterior 214 having a corner to corner diagonal dimension substantially equal to the diameter of the cylindrical exterior 212. Also at the lower end, flag staff attachment 200 has an internal bore 216 centered along the longitudinal axis of flag staff attachment 200. Bore 216 is threaded with threads 218 and is dimensioned to receive threaded rod 112 of flag staff 100. Hexagonal exterior 214 is adapted for receiving a wrench, or the like, for facilitating the tightening of the threads 218 of flag staff attachment 200 and those of threaded rod 112 of flag staff 100. It would be evident to one skilled in the art that exterior shapes other than hexagonal (e.g. two flat sides on opposite sides of an otherwise cylindrical exterior) capable of holding a wrench could be utilized without departing from the spirit of the invention.

At a second, upper end, body 210 maintains a substantially cylindrical shape, while being formed of a number of different elements. A pair of opposing cap retaining walls 220 rise above the level of the top of internal bore 216. Each cap retaining wall 220 has an exterior surface continuing the cylindrical shape of the lower portion of body 210 and a substantially flat interior surface 222. Interior surface 222 is substantially tangential to the perimeter of internal bore 216, thereby giving cap retaining wall a maximum thickness substantially equal to the thickness of body 210 surrounding internal bore 216. Centered at the upper end of internal surface 222 is a rigid, substantially rectilinear cap retainer 224 rigidly extending inwardly from internal surface 222 such that the opposing cap retainers 224 are spaced apart by a distance slightly greater than the width of engagement member 316 (to be discussed hereinafter).

Likewise, a pair of opposing cap retaining clip walls 226 occupy a portion of the perimeter of body 210 between the pair of cap retaining walls 220. The exterior surface 228 of each cap retaining clip wall 226 tapers inwardly from its base at the top of internal bore 218 to the upper end of body 210. The internal surface 230 of cap retaining clip wall 226 rises substantially tangential to the perimeter of internal bore 216 and normal to interior surface 222 of retaining cap walls 220. A substantially rectilinear cap retaining clip 232 extends inwardly from the upper extreme of interior surface 230 such that the opposing cap retaining clips 232 are spaced apart by a distance slightly less than the length of engagement member 316 (to be discussed hereinafter). The inner face of cap retaining clip 232 has a concavity having an arc segment substantially following a perimetric line.

As illustrated by FIGS. 6 thru 8, retaining cap 300 has a circular disk 310 having a diameter and a thickness. A solid rectilinear block 312 having a height, a width and a length, depends from a lower surface of circular disk 310 along a diameter line of circular disk 310, terminating at each end at a point equidistant from the perimeter of circular disk 310, each end being rounded to substantially conform to an arc of a perimetric line.

A post 314 attached at a proximal end at the center of rectilinear block 312 and circular disk 310 depends from rectilinear block 312 length and has a diameter substantially equal to the width of solid rectilinear block 312. A substantially rectilinear engagement member 316 is situated at the distal end of post 314. Engagement member 316 has a width substantially equal to the diameter of post 314 and is normal to and centered upon the distal end of post 314, extending an equal length in each direction from post 314. The length of engagement member 316 is normal to the length of rectilinear block 312. As best seen in FIG. 7, the ends of engagement member 316 are beveled such that the upper side (abutting post 314) of engagement member 316 is longer than the lower side of engagement member 316. As best seen in FIG. 8, the beveled ends of engagement member are arcuately shaped.

A pair of flag retaining clips 318 depend from the lower surface of circular disk 310, one on each of the two long sides of rectilinear block 312. Each flag retaining clip 318 further consists of a pedestal base 320, pedestal base 320 being spaced apart from and having a first side having a length substantially parallel to rectilinear block 312 and a second side with its length lying in an arc of substantially the same perimetric line as the ends of rectilinear block 312. A flag retaining head 322 depends from each pedestal base 320, first side of pedestal base 320 extending to form a first length side of flag retaining head 322. A lip extends substantially normal to the second side of pedestal base 320 to form a notch 324 between flag retaining head 322 and circular disk 310, notch 324 being adapted to retain the rim of an aperture 402 of a golf hole flag sleeve. Flag retaining head 322 is beveled from the extreme lower edge of the first side to the extreme edge of the lip, the bevel 325 allowing the flag retaining clip 318 to easily slide through the aperture 402.

Figure 9:
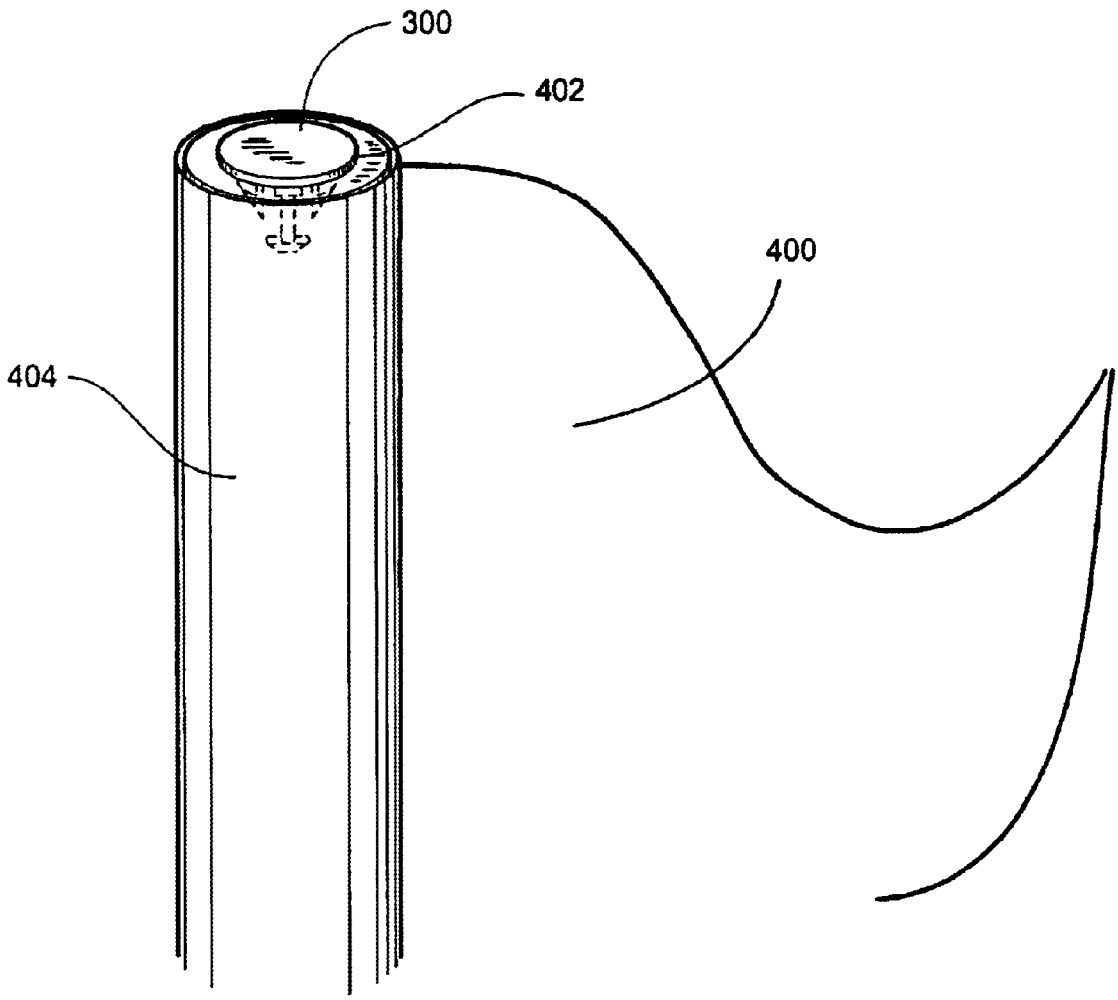
FIG. 9 is a environmental perspective of the retaining cap attached to a flag.

A illustrated in FIG. 9, in use, retaining cap 300 is inserted through the aperture 402 of the sleeve 404 of a golf flag 400, such that the rim of the aperture 402 is retained between circular disk 310 and the flag retaining heads 322 of flag retaining clips 318. The bevel 323 of the flag retaining heads 322 facilitate the compression of the flag retaining clips 318 toward the center of retaining cap 300, allowing the rim of the aperture 402 to slide over flag retaining heads 318. After the rim of aperture 402 has passed over the flag retaining heads 318, the flag retaining clips 318 return to a non-compressed position, thereby constraining the rim of aperture 402 between circular disk 310 and the flag retaining heads 318. The ends of the rectilinear solid 312, being substantially of a same perimetric line as the outer edges of the pedestal bases 320 of flag retaining clips 318, in cooperation with pedestal bases 320, provide an internal filler to maintain the aperture 402 in steady position. It would be evident to one skilled in the art that rather than inserting a retaining cap 300 through aperture 402 of a flag sleeve 404, retaining cap 300 could be formed as an integral part of flag sleeve 404 without departing from the spirit of the invention.

Figure 3:
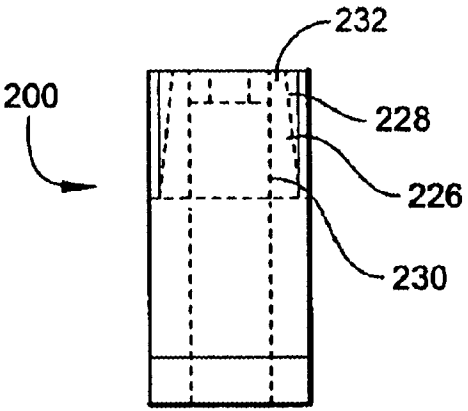
FIG. 3 is a side view of the flag staff attachment of FIG. 2.
Figure 2:
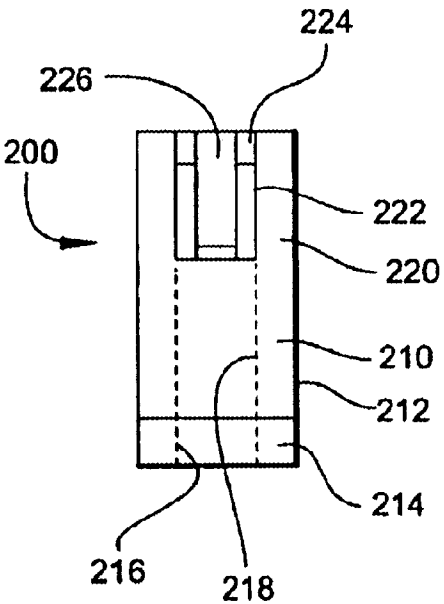
FIG. 2 is a front view of the flag staff attachment of the present invention.

Once the retaining cap 300 has been inserted into the aperture 402 of the flag 400, engagement member 316 is inserted into the opening between the two cap retaining clips 232. The bevel of the ends of engagement member 316 facilitates the outward deflection of the cap retaining clips 232 and cap retaining clip walls 226 such that engagement member 316, having a length slightly greater than the distance between the cap retaining clips 232, may pass between the cap retaining clips 232. The combination of the engagement member 316 being beveled, the limited height of cap retaining clips 232 (as seen in FIG. 3), and the correspondingly arcuate shapes of the ends of engagement member 316 and the inner faces of cap retaining clips 232, allows for easy removal of retaining cap 300 from the flag staff attachment 200 by aligning engagement member 316 with the cap retaining clips as shown in FIG. 7, and applying a rotational force to the retaining cap about an axis parallel to the longitudinal axis of rectilinear block 312.

In a preferred embodiment, flag staff attachment 200 and retaining cap 300 would each be formed unitarily by a method such as, but not limited to, injection molding of a polymeric material. Other light weight materials could, of course, also be suitable and other forming methods could be utilized.

It is to be understood that the present invention is not limited to the embodiments described above, but encompasses any and all embodiments within the scope of the following claims.

What is claimed is:

1. A quick release fastener for flags and flag staffs comprising:

a flag staff attachment further comprising:

a body having a width and a length, said body having a hexagonal shape on at least a lower end of said length thereof, said body further having an internal, threaded bore in a lower surface thereof, a pair of opposing cap retainers proximate an upper end of the length thereof, and a pair of opposing cap retaining clips proximate said upper end thereof, and a retaining cap further comprising:

a disk having a width substantially equal to that of said body of said flag staff attachment, at least two opposing flag retaining clips, and an engagement member, said retaining cap being adapted to removeably engage a sleeve of a flag and said flag staff attachment.

2. A quick release fastener, as defined in claim 1, wherein said threaded bore is adapted to receive threads of a flag staff and said hexagonal shape is adapted to cooperate with a wrench.

3. A quick release fastener, as defined in claim 1, wherein said cap retainers are rigidly positioned, interior of said body, opposite one another, and spaced apart from one another.

4. A quick release fastener, as defined in claim 1, wherein said cap retaining clips are laterally displaceably positioned, interior of said body, opposite one another, and spaced apart from one another.

5. A quick release fastener, as defined in claim 1, wherein said engagement member has a width slightly narrower than the distance between said cap retainers and a length slightly greater than the distance between said cap retaining clips.

6. A quick release fastener, as defined in claim 5, wherein each of the two ends of said engagement member is beveled, thereby facilitating lateral displacement of said cap retaining clips, thereby allowing passage of said engagement member therebetween.

7. A quick release fastener, as defined in claim 1, wherein said flag retaining clips are spaced apart from said disk by a pedestal base such that a rim of an aperture in a flag sleeve may be retained between said flag retaining clips and said disk.

8. A quick release fastener, as defined in claim 7, wherein said flag retaining clips are laterally displaceable, thereby allowing passage of said aperture of said flag sleeve thereover.

9. A quick release fastener for flags and flag staffs comprising:

a flag staff attachment further comprising:

a substantially cylindrical body having a diameter and a length, said substantially cylindrical body transitioning to a hexagonal shape at a lower end of said length thereof, said hexagonal shape adapted to cooperate with a wrench, said body further having an internal threaded bore in a lower surface thereof, said threaded bore adapted to receive the threads of a flag staff, a pair of opposing cap retainers rigidly positioned, interior of said body, opposite one another, and spaced apart from one another, proximate an upper end of the length thereof, and a pair of opposing cap retaining clips positioned interior of said body, opposite one another, and spaced apart from one another, proximate said upper end thereof, said cap retaining clips being laterally displaceable, and a retaining cap further comprising:

a disk having a diameter substantially equal to that of said body of said flag staff attachment, at least two opposing, laterally displaceable, flag retaining clips spaced apart from said disk by a pedestal base such that a rim of an aperture of a flag sleeve may be retained between said flag retaining clips and said disk, and an engagement member having a width slightly less than the distance between said cap retainers and a length slightly greater than the distance between said cap retaining clips.

10. A quick release fastener for flags and flag staffs, as defined in claim 9, wherein said retaining cap is formed as an integral part of a flag sleeve.

11. A method for releasably attaching a flag to a flag staff comprising the steps of:

providing a quick release fastener for flags and flag staffs comprising:

a flag staff attachment further comprising:

a substantially cylindrical body having a diameter and a length, said substantially cylindrical body transitioning to a hexagonal shape at a lower end of said length thereof, said hexagonal shape adapted to cooperate with a wrench, said body further having an internal threaded bore in a lower surface thereof, said threaded bore adapted to receive the threads of a flag staff, a pair of opposing cap retainers rigidly positioned, interior of said body, opposite one another, and spaced apart from one another, proximate an upper end of the length thereof, and a pair of opposing cap retaining clips positioned interior of said body, opposite one another, and spaced apart from one another, proximate said upper end thereof, said cap retaining clips being laterally displaceable, and a retaining cap further comprising:

a disk having a diameter substantially equal to that of said body of said flag staff attachment, at least two opposing, laterally displaceable, flag retaining clips spaced apart from said disk by a pedestal base such that a rim of an aperture in a flag sleeve may be retained between said flag retaining clips and said disk, and an engagement member having a width slightly less than the distance between said cap retainers and a length slightly greater than the distance between said cap retaining clips;

inserting said retaining cap through said aperture of said flag sleeve of at least one flag such that said rim of said flag sleeve aperture laterally displaces said cap retaining clips inwardly, allowing said rim of said aperture to be slid over said cap retaining clips thereby constraining said rim of said sleeve between said disk and said flag retaining clips;

threading said threaded bore of one of said flag staff attachments onto threads of at least one of said flag staffs;

installing one of said at least one flag on said flag staff by:

selecting a flag having a retaining cap attached thereto, sliding said sleeve of said flag over said flag staff attachment and said flag staff, aligning said engagement member with said space between said cap retainers and said cap retaining clips, pressing said retaining cap into said flag staff attachment such that said engagement member displaces said cap retaining clips laterally, thereby allowing said engagement member to pass through said cap retaining clips, thereby securing said engagement member below said cap retainer.

12. The method of claim 11, further comprising the step of removing said flag from said flag staff by:

aligning said engagement member with said space between said cap retainers and said cap retainer clips, pulling on said retaining cap and applying a rotational force about an axis perpendicular to said length of said engagement member such that said engagement member displaces said cap retaining clips laterally, thereby allowing said engagement member to pass between said cap retaining clips, and removing said flag sleeve from said flag staff and said flag staff attachment.

* * * * *